US009493852B2

(12) United States Patent
Frølund

(10) Patent No.: US 9,493,852 B2
(45) Date of Patent: Nov. 15, 2016

(54) HAIR CONTROLLER FOR A PELT STRETCHING MACHINE

(71) Applicant: Dansk Mink Papir A/S, Holstebro (DK)

(72) Inventor: Søren Frølund, Holstebro (DK)

(73) Assignee: Dansk Mink Papir A/S, Holstebro (DK)

( * ) Notice: Subject to any disclaimer, the term of this patent is extended or adjusted under 35 U.S.C. 154(b) by 111 days.

(21) Appl. No.: 14/295,817

(22) Filed: Jun. 4, 2014

(65) Prior Publication Data

US 2014/0373577 A1 Dec. 25, 2014

(30) Foreign Application Priority Data

Jun. 24, 2013 (EP) ..... 13388005

(51) Int. Cl.
*C14B 15/06* (2006.01)

(52) U.S. Cl.
CPC ..... *C14B 15/06* (2013.01)

(58) Field of Classification Search
CPC ..... C14B 15/06
See application file for complete search history.

(56) References Cited

U.S. PATENT DOCUMENTS 1,911,098 A * 5/1933 Weber ..... D06B 1/02 118/325
2,573,292 A 10/1951 Yost
4,649,606 A * 3/1987 Fay ..... D06C 13/00 26/15 R
4,654,969 A * 4/1987 Schwartzott ..... B23D 59/04 30/123.3
5,318,420 A * 6/1994 Blaimschein ..... B26D 7/086 264/138
5,557,853 A * 9/1996 Andre ..... B26F 1/382 30/123.3
6,035,749 A * 3/2000 Haselwander ..... D06C 3/02 26/16
6,640,680 B2 * 11/2003 Becan ..... D06C 3/02 26/16
7,900,488 B2 3/2011 Hedegaard
2004/0060330 A1 * 4/2004 Hedegaard ..... C14B 15/06 69/21
2007/0028655 A1 * 2/2007 Hedegaard ..... C14B 15/06 69/21

OTHER PUBLICATIONS

EP Search Report for corresponding EP application 13388005.4, mailed Nov. 20, 2013, 4 pages.

* cited by examiner

*Primary Examiner* — Shaun R Hurley
(74) *Attorney, Agent, or Firm* — Klein, O'Neill & Singh, LLP

(57) ABSTRACT

The present invention is a hair controller for mounting on a stretching machine used for stretching a pelt on a pelt board. The stretching machine has at least one holder for engaging the pelt. The hair controller includes a device for moving hair aside to expose a selected area of leather on the pelt, in particular the area of leather engaged by the holder. Also disclosed is a method for moving the hair of a pelt aside before the pelt is fixed by a holder in a stretching machine.

18 Claims, 10 Drawing Sheets

PRIOR ART

HAIR CONTROLLER FOR A PELT STRETCHING MACHINE

CROSS REFERENCE TO RELATED APPLICATIONS

This application claims priority in European patent application no. 13 388 005.4, filed 24 Jun. 2013, the contents of which are incorporated by reference.

TECHNICAL FIELD

The present invention relates to a hair controller for mounting on a stretching machine for stretching a pelt on a pelt board.

BACKGROUND

Pelts or furs are highly appreciated in the clothing and fashion industry. In particular pelts or furs from animals such as fox and mink are highly valued. The furs are traditionally produced from animals bred on farms where it is possible to produce healthy animals with desired properties, whereby the desire for fur with specific qualities such as colour and hair density may be met.

Normally, the farmed animals are killed and skinned, and then the fur or pelt is treated to obtain a high quality fur. When the fur is removed from the animal body, the fur is scraped to remove traces of fat and meat and thereafter mounted on a pelt board for stretching and drying. The stretching is carried out by mounting the pelt board with the fur in a stretching machine, e.g. as disclosed in European Patent EP 1678331 B1 (U.S. Pat. No. 7,900,488).

The stretching machine comprises one or more holders, conventionally four holders to hold a part of the fur in a fixed position. This means, that in the conventional stretching machine, two holders hold the fur on its back side and two holders hold the fur on its stomach side. The holders are adapted to press against a flange in which the pelt board is slidably mounted. A part of the fur, i.e. the lower part of the fur closest to the tail, is mounted on the flange and is squeezed between the flange and the holders when the stretching machine is activated. Thus, when the stretching machine is activated, the holders squeeze the fur towards the flange and fix this lower part of the fur. Subsequently, the stretching machine pushes the pelt board upwards in a sudden movement, thereby stretching the fur in the longitudinal direction.

As the furs are paid according to size, the farmers try to stretch the furs as much as possible. However, as explained above, when the stretching machine is activated, the holders are also activated and squeeze the fur between the flange and the holders. This will also mean that hair is squeezed and caught between the holders and the flange, which may cause the hairs to be pulled out of the fur. This is in particular a problem when the fur is subjected to more extreme stretching. Moreover, the treatment may also cause damage to hair follicles, causing hair to fall off the fur, leaving hairless spots.

The hairless spots on the fur are highly undesired, as it may cause the potential buyers to reject the fur, or if the fur is not rejected the price will be significantly reduced. Consequently, it is desirable to be able to stretch the furs longer without damaging parts of the fur, and avoiding the hairless spots.

SUMMARY OF THE INVENTION

An object of the present invention is to provide a device which makes it possible to obtain longer stretching of the fur, while still maintaining a high quality of furs, where the drawbacks such as hairless spots are avoided.

Thus, the present invention relates to a hair controller for mounting on a stretching machine for stretching a pelt on a pelt board, which machine comprises at least one holder to engage the pelt, and wherein said hair controller comprises means for moving hair aside to expose a selected area of leather on the pelt.

The selected area of leather to be exposed, i.e. the area where the hairs are moved aside, is substantially the area where the holder will engage the pelt and squeeze towards the flange. When the hairs are moved aside, the holder will be able to press directly on the leather without hairs getting caught and pulled off during stretching of the fur.

The stretching machine may be any well-known type of stretching machine. The holders, however, may in principle be any kinds of holders that are able to work with the stretching machine. The function of the holder may be based on mechanical forces as in the traditional stretching machine. The function of the holder may also be based on magnetic forces, and in principle the holder may be any holder that may serve to hold a selected part of the fur in a fixed position. The requirement with respect to the holder is that it is able to hold a part of the fur in a fixed position relative to a movement of the pelt board.

The conventional stretching machine comprises at least one holder, and preferably four holders. The stretching machine normally comprises one or two holders to hold the pelt on its back side and also one or two holders to hold the pelt on its stomach side.

As a hair controller according to the invention is intended to provide access for the holder to the leather without hairs getting caught, it is preferred that the hair controller is mounted on or in connection with the holder. The hair controller may also be mounted in a way so the hair controller substantially surrounds the holder. Such embodiments allow for the hair controller to be mounted on holders in existing stretching machines.

In an alternative embodiment, the hair controller is integrated in the holder. This alternative embodiment may provide a holder with a hair controller according to the invention which may be produced with a very compact structure which does not require more space in the stretching machine than the traditional holder without the hair controller. It is also possible to mount holders with integrated hair controllers on existing stretching machines.

In an embodiment of the hair controller, the device for moving hair aside comprises one or more nozzles or orifices for providing a stream of air. Consequently, the one or more nozzles may send a stream or flow of air towards an area of the fur, whereby the hair on the fur is moved aside, thereby providing access to the leather. Preferably the air stream has a substantially laminar flow. A substantially laminar flow of air will have good properties in respect of moving hairs aside on a pelt as the flow of air will form an "air blade".

The outlet opening of the nozzle may have a circular cross-section, or it may have an elongated cross-section and as such be shaped as orifices. The one or more nozzles should be adapted to provide a substantially laminar air flow, which will have the best properties in respect of moving the hair aside. The size and direction of the nozzles may be optimised to achieve the best possible result in respect of moving hair aside. Also the speed of the air flow may be adjusted by selecting a suitable source of air flow. The source of air is preferably compressed air from which a stream of air may be provided by selecting a suitable size of the nozzles.

In an alternative embodiment the device for moving hair aside is one or more suction devices. The suction devices may be one or more tubular members or members with orifices. The members may be connected to a suction engine, e.g. a pump or other suction means, which will suck air away from the area around the suction devices, thereby establishing a local vacuum which moves the hair aside when the vacuum is in the vicinity of the pelt.

In a further embodiment of the hair controller, the device for moving hair aside is one or more plates. In this particular embodiment, the hair is moved aside by the action of a least one plate, in particular one or two plates. When the holder is activated, the plate or plates are moved in front of the holder to press the hair on the fur aside, whereby the holder is given access to squeeze directly on the leather.

The plates may be pivotally mounted and connected with a motor or other device, which will allow the plates to move and thereby facilitate the movement of the hair aside. The plates may also be adapted to vibrate or oscillate.

The plates may be in the form of combs, which have good properties in respect of moving the hair aside.

In an alternative embodiment of the hair controller, the device for moving hair aside is an electrically charged body. The electrically charged body may in principle be the holder alone, provided that the holder is made from a conductive material. The charged body may also be mounted as an extra device on or in connection with the holder.

When the hair controller is a charged body, the pelt may be subjected to an electric charge corresponding to the charge of the charged body, i.e. having the same polarity. In this way the hair controller and the hair on the pelt will repel each other and in this fashion the hair is moved aside when the charged hair controller is approaching the pelt.

Moreover, the charged body may be based on the principles of the van der Graaf generator utilising the electrostatic forces that may be built up by the action of a dielectric or insulating material combined with a conductive material.

The charged body may also utilise the principles of static electricity. The charged body may also be ion sticks or similar devices.

As mentioned, the hairs on the pelt and the holder should in principle have the same polarity. In this manner, the hairs and the holder will have a mutual repelling effect.

The hair controller for moving hair aside may also be a vibrating holder. If the hair controller is constituted by the holder and the holder is brought to vibrate during activation, the vibration may cause the hair to be moved aside. The vibration of the holder may be combined with use of electric charges, a stream of air or one or more plates as described above.

The vibration may be an oscillating movement in one, two or more directions and with one or more oscillations per second, e.g. 5, 10, 15 or more than 50 or even more 100 oscillations per second.

In an alternative embodiment of the hair controller, the device for moving hair aside is one or more brushes. In this embodiment, a brush may be placed in the vicinity of the holder, and when the holder is activated the brush may rotate and move the hair aside. Two brushes may also be used, which may have opposite directions of rotation. More brushes may also be used in extension of each other.

The hair controller may also comprise a device for keeping the hairs that have been moved aside in a fixed position. Such a device will ensure that the hairs do not move back into the previous position before the holder engages with the leather, i.e. the device serves to ensure that the hair does not get caught between the leather on the flange and the holder. The hair controller may also comprise one or more nozzles which may spray a liquid, such as water, onto to the pelt for the purpose of fixing the hairs.

The hair controller may also be a combination of air flow, plates and/or brushes or a combination of plates and suction devices or any other combination.

The present invention also comprises a method of reducing hairless spots on a pelt which is mounted on a pelt board and stretched in a stretching machine. The method comprises the steps of:

mounting the pelt on a pelt board;

placing the pelt board with the pelt in a stretching machine;

fixing the lower part of pelt with at least one holder;

stretching the pelt;

wherein the hairs on the pelt are moved aside, preferably by means of a hair controller, from the area where the at least one holder is intended to fix the pelt before the holder fixes the pelt.

By moving the hairs aside on the pelt on the area or the areas where the holder or the holders fix the pelt, the hairs do not get caught by the holder when the pelt is stretched. Thereby, the hairs are not torn off the leather, and the risk of hairless spots is reduced or substantially avoided.

According to the method, the step of moving the hairs aside may comprise use of compressed air, a flow of air, vacuum or suction means. These means may correspond to the means of the hair controller previously described.

In the method, the step of moving the hair aside may also comprise mechanical or electrical means, such as plates, combs, brushes, ion sticks, and electrical charged devices as previously described.

BRIEF DESCRIPTION OF THE DRAWINGS

The invention will now be explained with reference to the drawings, in which.

DETAILED DESCRIPTION OF THE INVENTION

Figure 1:
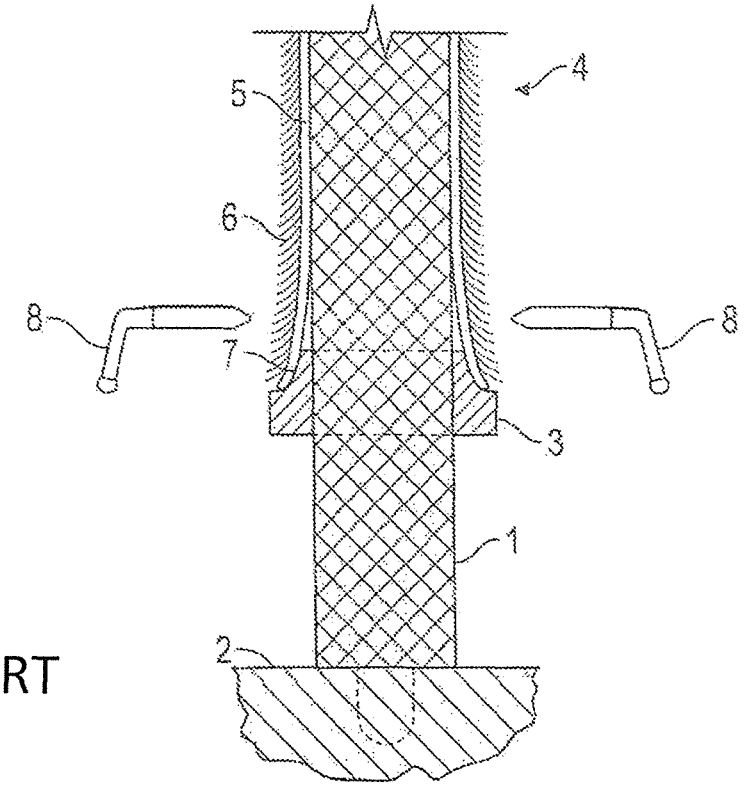
PRIOR ART FIG. 1
FIG. 1 shows the basic principles of a traditional stretching machine.

The figures are only intended to show the principles of the present invention. Consequently, some details that have no relevance in respect of the invention have been omitted. In the drawings, the same reference numbers have been used for the same parts.

In the context of the present invention, the terms "fur" and "pelt" are used synonymously. The pelt or fur comprises leather with hair on one side.

Moreover, the terms "compressed air" and "pressured air" are used substantially synonymously and to be considered as a source for providing a stream or flow of air in some of the embodiments of the hair controller.

FIG. 1 is a section that shows the principles of a traditional stretching machine. A pelt board 1 is mounted on a base 2 of a stretching machine. The pelt board 1 also passes through the flange 3. The pelt board 1 is able to slide in the flange 3.

The pelt board 1 is preferably a hollow pelt board with openings in the surface for drying air and made from a polymer material. The pelt board may also be made from metal such as a metal net or the pelt board may be made from wood, such as solid wood. The pelt board has a tapering shape in the direction from the bottom (tail end) to the top (nose end). This tapering shape provides stretching properties of the pelt board in the transverse direction of the fur. However, the stretching of the fur in the longitudinal direction has to be performed in a stretching machine.

A fur 4 comprising leather 5 and hair 6 is mounted on the pelt board 1 in such a way that the lower part of the fur 4 is placed on the outer surface 7 of the flange 3. The placing of the fur part on the outer surface 7 of the flange 3 allows the holders 8 to engage the fur 4 and press it towards the flange 3, whereby the lower end of the fur is held in a fixed position on the flange.

Figure 2:
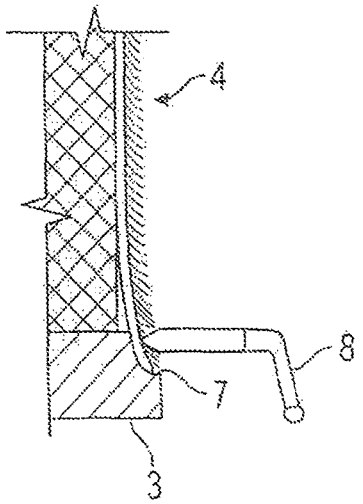
PRIOR ART FIG. 2
FIG. 2 shows a traditional holder holding a fur.

This situation is illustrated in FIG. 2 showing one holder 8 pressing the lower part of the fur 4 towards the surface 7 of the flange 3.

What in principle will happen when the fur 4 is held by the holders, is that the base 2 of the stretching machine will make a rapid upward movement towards the flange 3, in which the pelt board 1 will slide in the longitudinal direction. The upward movement of the pelt board will result in a stretching of the fur 4 due to the fixation of the lower part of the fur at the position of the flange 3.

Figure 3:
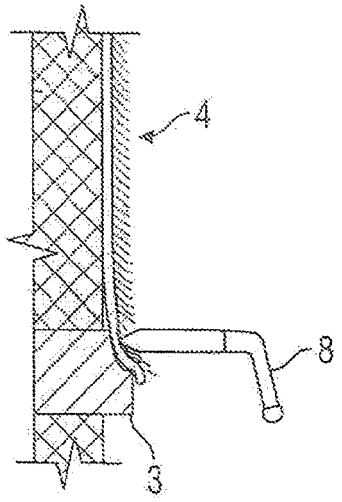
FIG. 3 PRIOR ART
FIG. 3 shows a fur fixed in a stretching machine.
Figure 4:
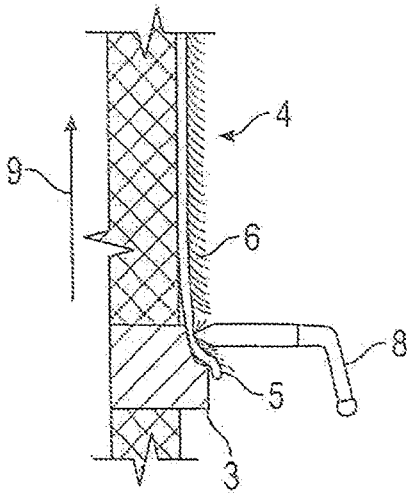
FIG. 4 PRIOR ART
FIG. 4 shows the stretching of the fur.
Figure 5:
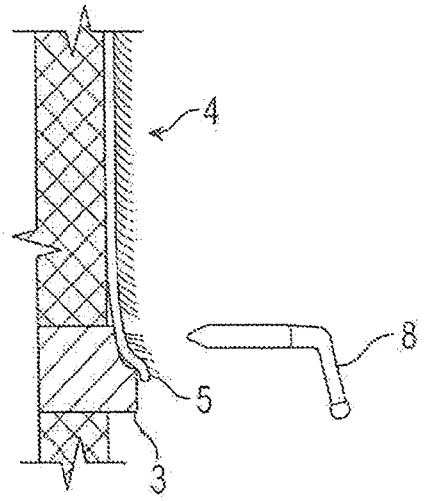
FIG. 5 shows the fur subsequent to stretching.

The FIGS. 3, 4 and 5 show the situation in a traditional stretching machine when the fur is stretched.

FIG. 3 shows the situation just before stretching. The fur 4 mounted on a pelt board 1 is placed in the stretching machine, and the pelt board 1 is passing through the flange 3 on which the lower part of the fur 4 is placed and squeezed towards the flange 3 by the action of the holder 8.

FIG. 4 shows the stretching in which the pelt board 1 is moved in the direction of the arrow 9. The hairs 6 which are squeezed and caught between the holder 8 and the flange 3 are torn off the leather 5. Moreover, the pressure from the holder directly on the hair follicles may destroy the hair follicles, which will mean that the hairs fall off later.

Consequently, the result of the stretching is an area of leather 5 without hairs, as shown in FIG. 5. The situation with hairless areas on the fur 4 is naturally highly undesired for the farmers. The value of the fur is determined by the length among other parameters, and the length is measured in millimeters. Consequently, the farmers aim at stretching the fur as much as possible to get as high prices as possible. However, the stretching bears the risk that the fur may be damaged with hairless areas as described. This may have as a result that the fur is rejected, or the price is set significantly lower than the price for a premium fur where the hairs are intact.

Figure 6:
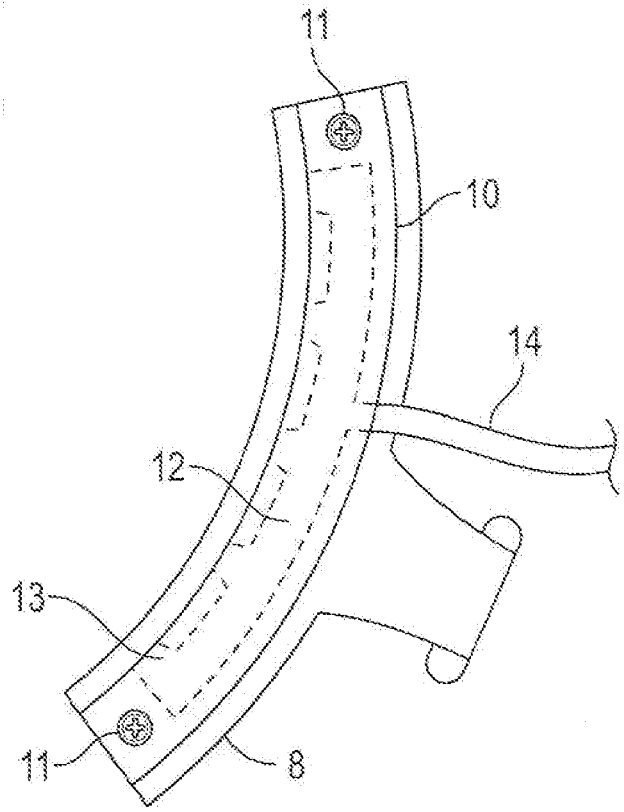
FIG. 6 shows an embodiment of a hair controller according to the invention.

FIG. 6 shows a holder 8 with a hair controller 10. In this particular embodiment, the hair controller 10 is mounted on a conventional holder 8 for a stretching machine.

The hair controller 10 is mounted on the holder 8 by screws 11. Alternatively the hair controller 10 may be mounted with rivets or glued on welded on the holder 8. As such the hair controller may be attached to the holder by any suitable means. The hair controller 10 comprises an internal channel 12 (indicated by dotted lines) connected with nozzles 13. The channel 12 is adapted for providing pressurized air for the nozzles 13. The pressurized air is delivered to the hair controller via pipe 14. The pressurized air may originate from the pressurized air that is utilized to operate the stretching machine, i.e. activate the holders and squeeze them toward the flange.

Figure 7:
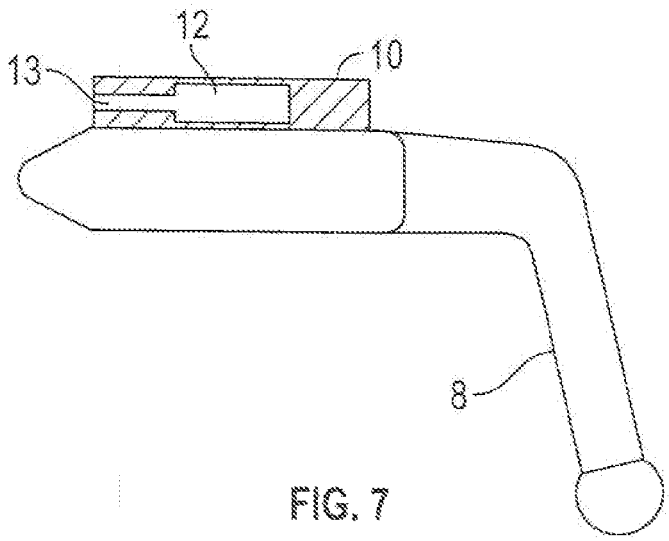
FIG. 7 shows a section of the hair controller.

FIG. 7 is a section through the hair controller 10 seen in FIG. 6. The channel 12 connected to the nozzle 13 is seen within the hair controller, which is mounted on the holder 8 in such a way that the nozzle 13 will provide a flow of air in the direction in which the holder will be moved when engaging a fur. Thereby, the flow of air will move the hair aside, allowing the holder to press directly on the leather of the fur.

Figure 8:
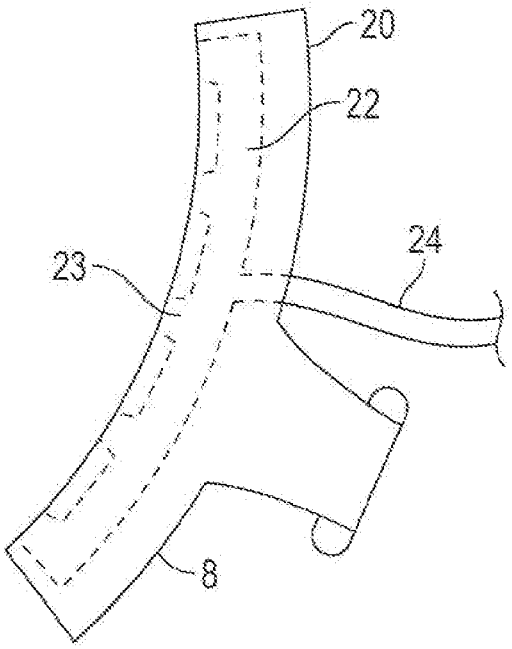
FIG. 8 shows an alternative embodiment of the hair controller.

FIG. 8 shows an alternative hair controller 20 which is integrated in the holder 8. The holder 8 comprises a channel 22 which is connected with a series of nozzles 23 along the front of the holder 8. The nozzles 23 and the channel 22 constitute the hair controller integrated in the holder. The hair controller is supplied with pressurized air via a pipe 24.

Figure 9:
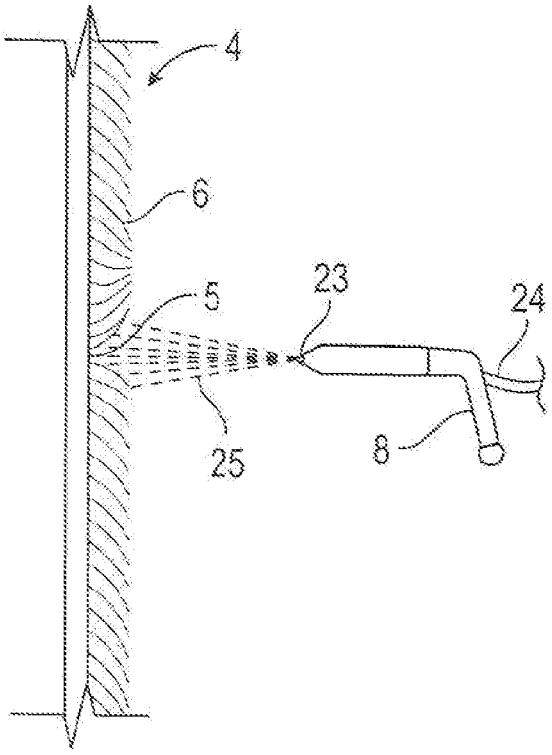
FIG. 9 shows the working principles of the hair controller of FIG. 8.

FIG. 9 is a section of the hair controller 20 of FIG. 8. FIG. 9 is shows the principles of a hair controller operating with pressurized air. FIG. 9 indicates a flow of air 25 (dotted lines) from the nozzle 23. The flow of air is caused by pressurized air supplied to the nozzle 23 via the channel 22 and the pipe 24.

The flow of air 25 causes the hair 6 to move aside and provides access to an area of leather 5 on the fur 4 for the holder 8. When the holder 8 is brought close to the area of leather between the hairs, the flow of air will cease. The flow of air 25 is preferably a laminar flow which is obtained by adjusting the air speed through the nozzles 23.

Moreover, the air flow is only maintained during the period when the holder 8 is brought into contact with the fur. Thus, the air flow may be delivered as a short pulse of pressurized air providing the air flow. The specific characteristics of the air flow may be determined by the skilled person. The characteristics are dependent on the type of fur, orientation of the hairs, density of the hairs, etc.

Figure 10:
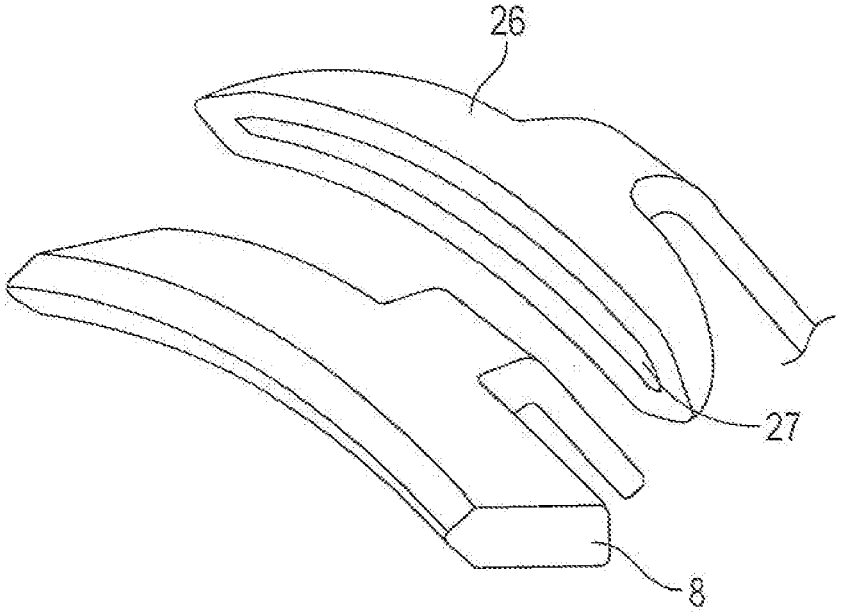
FIG. 10 shows an alternative embodiment of a hair controller using air flow.

FIG. 10 shows an alternative embodiment of an alternative embodiment of a hair controller 26 utilizing air to provide a stream of air to move hair aside. The hair controller 26 comprises an elongate orifice 27 through which the flow of air may flow in the direction of the fur moving the hair aside, whereby the holder 8 may get in contact with the leather. Although, the hair controller may be mounted on the holder 8 and follow the movement of the holder, the hair controller 26 need not being mounted on the holder 8, but may e.g. be mounted in a fixed position with a substantially fixed distance to the fur.

Moreover, it has appeared that the best function seems to be achieved with the hair controller 26 mounted in a fixed position with a fixed distance from the fur. Thus, it is believed that it is possible to achieve a substantially optimum laminar flow of air with this embodiment.

Figure 11:
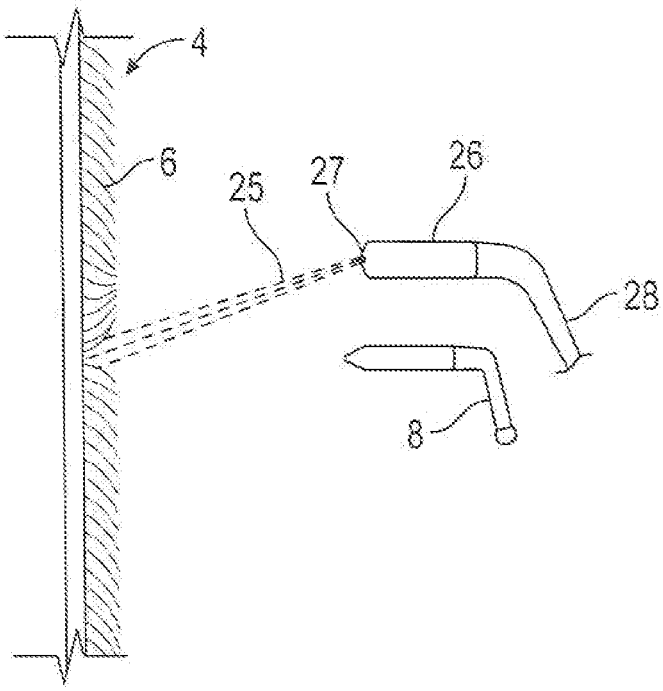
FIG. 11 shows the working principles of the hair controller of FIG. 10.

FIG. 11 shows the working principle of the hair controller 26. From the orifice 27 in the hair controller 26, a stream of air indicated with dotted lines 25 is send towards the fur 4 moving the hair aside and allowing access for the holder 8 to the leather. The air is provided to the hair controller via the pipe 28 which may be connected with a source for pressured air.

Figure 12:
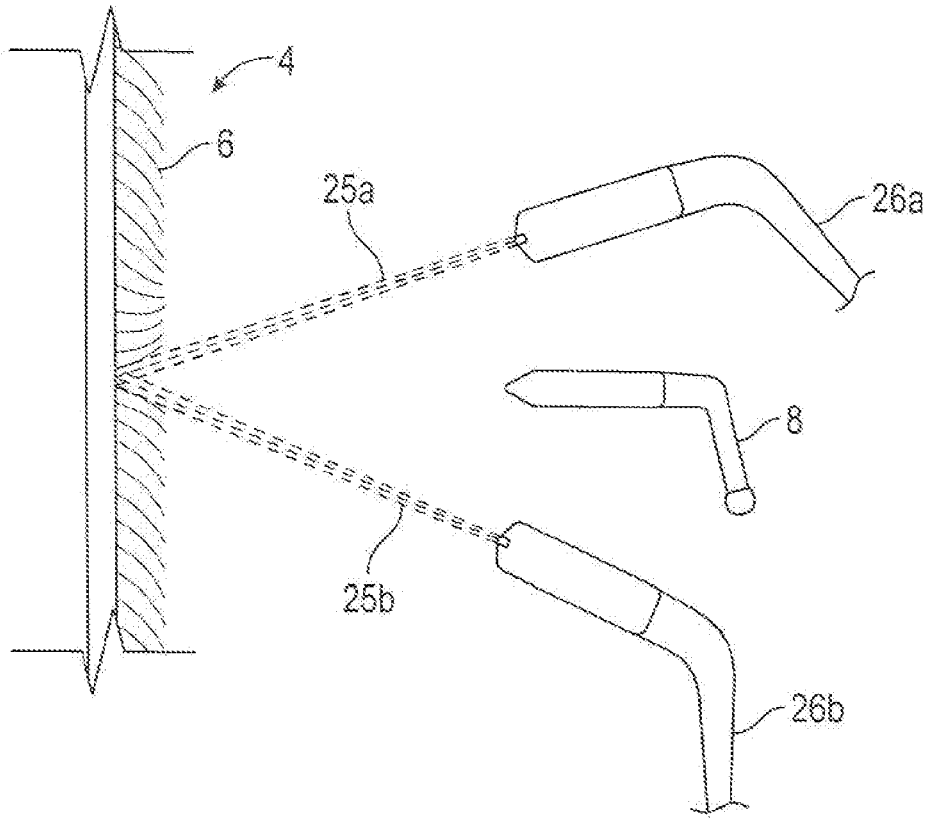
FIG. 12 shows an alternative embodiment based on air flow.

FIG. 12 shows an alternative embodiment using the hair controller 26. In this embodiment two hair controllers 26*a* and 26*b* are used. The hair controller 26*a* is mounted above the holder 8 and the hair controller 26*b* is mounted below the holder 8. The hair controllers 26*a* and 26*b* provides two streams of air 25*a* and 25*b* towards the fur 4 thereby moving the hair aside. The streams of air 25*a* and 25*b* are preferably a laminar flow of air. In this embodiment the hair controllers 26*a* and 26*b* substantially surround the holder 8.

Figure 13:
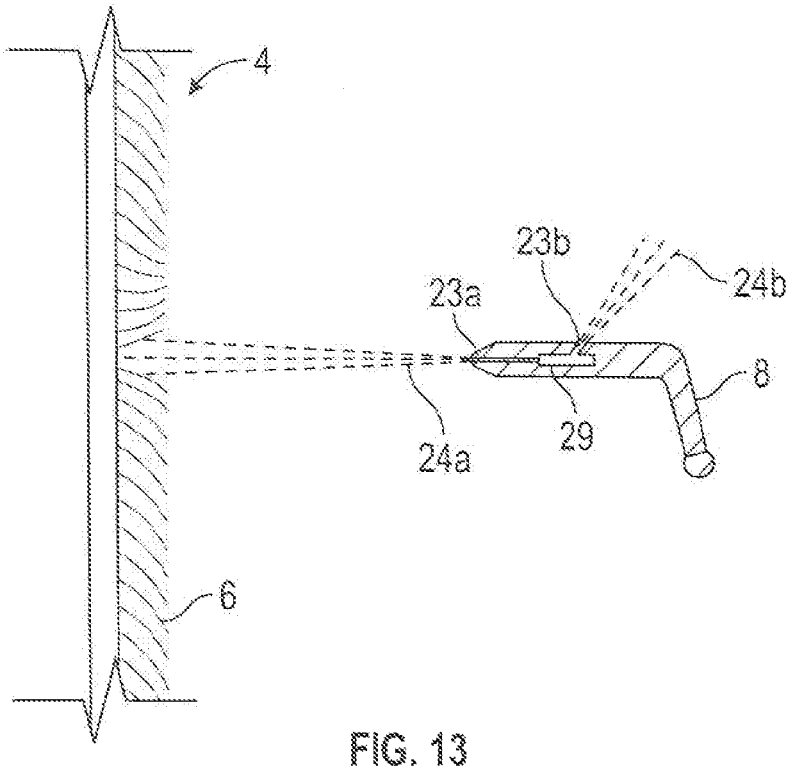
FIG. 13 shows yet alternative embodiment based on air flow.

FIG. 13 illustrates yet an alternative embodiment of a hair controller using streams of air. In this particular embodiment the holder 8 is shown cut through to show an air chamber 29 integrated in the holder 8. The air chamber 29 distributes air to nozzles 23*a* which will send a stream of air 24*a* towards the fur 4. The stream of air 24*a* will move the hair 6 aside and provide access to the leather for the holder 8. The air chamber 29 will, moreover, distribute air to nozzles 23*b* which will send a stream of air in a direction away from the fur. In the shown embodiment the stream of air 24*b* from the nozzle 23*b* has an angle in respect of the stream of air 24*a* from the nozzle 23*a* of about 110 degrees. However, other different angles between the streams of air may be convenient to use.

The stream of air 24*b* form the nozzles 23*b* may serve to improve effect of the air flow 24*a* from the nozzles 23*a* by reducing the risk of turbulent flow. When the amount of turbulent flow is reduced, i.e. the flow is becoming more laminar, the function of the hair controller is improved. Thus, the streams of air 24*a* and 24*b* preferable are laminar flows of air. The principle may be used in connection with any hair controller based on a flow of air.

Figure 14:
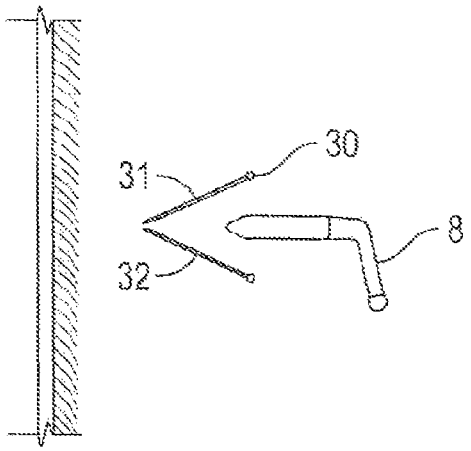
FIG. 14 shows a hair controller with plates.

FIG. 14 shows yet an alternative hair controller 30. This particular hair controller 30 comprises two plates 31 and 32 which are shaped to follow the front part of the holder 8. When the holder 8 with the hair controller 30 is activated, the plates initially form a V-shape in front of the holder.

Figure 15:
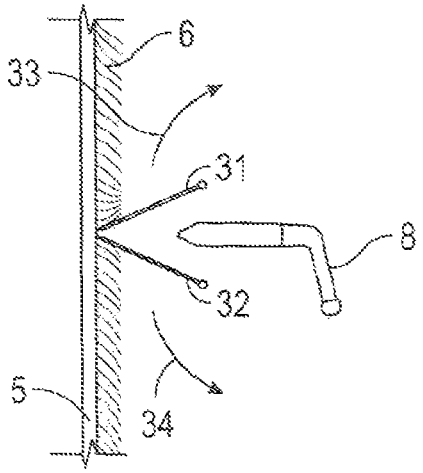
FIG. 15 shows the function of the hair controller with plates.

As will be seen in FIG. 15 the V-shaped hair controller 30 is moved into the fur 4 during the activation of the holder 8. When the hair controller 30 has entered the hair 6, the plates 31 and 32 are moved apart in the directions indicated by arrows 33 and 34, respectively.

Figure 16:
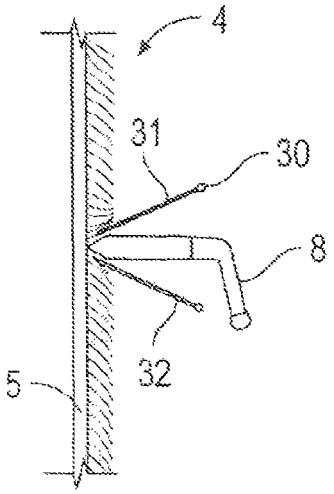
FIG. 16 shows the function of the hair controller with plates.

The movement of the plates 31 and 32 will move the hair aside, whereby the holder 8 may engage the leather 5 on the fur 4 without catching any hairs. This is shown in FIG. 16.

Some embodiments of the hair controller 30 may only require one plate which is pressed into the hair to lift it aside. The plates 31 and 32 may be designed as combs, and they may be manufactured from a suitable material such as a plastics material, wood, metallic material or a ceramic material.

Moreover, the plates may have means for providing a vibration or oscillation of the plates.

Figure 17:
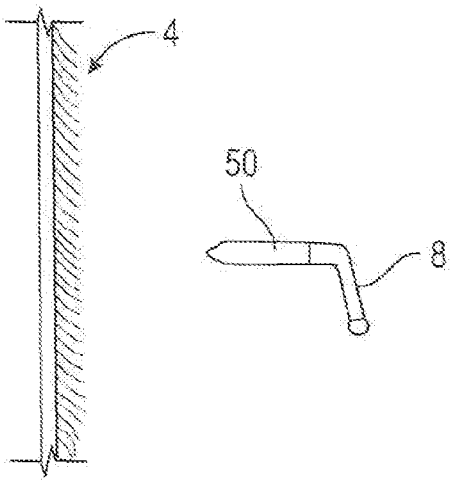
FIG. 17 shows a hair controller with electrically charged body.

FIG. 17 shows an embodiment of a hair controller 50 in which the controller is an electrically charged body. The shown embodiment is one of the simplest embodiments of a hair controller with electrically charged body, as the charged body is simply the holder 8. This embodiment may be realised relatively easily, when the holder 8 is made from a metallic material which is electrically conductive.

Figure 18:
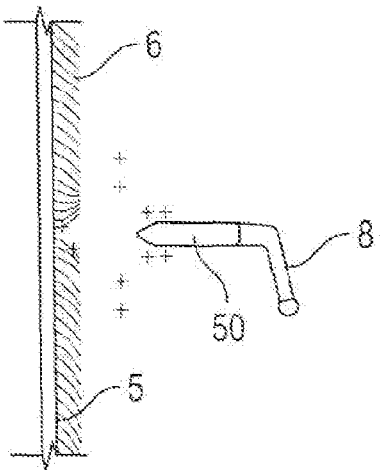
FIG. 18 shows the function of the hair controller with electrically charged body.

The basic principles of the hair controller 50 are shown in FIG. 18. In this embodiment, the holder 8 is applied with a positive electric charge, while the hair 6 on the fur 4 also carries a positive electric charge. Consequently, the holder 8 and the hair 6 will repel each other, as a result of which the hair 6 will move aside when the holder 8 approaches the fur 4.

Figure 19:
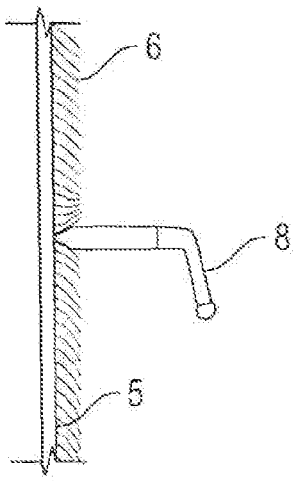
FIG. 19 shows the function of the hair controller with electrically charged body.

When the holder 8 is in contact with the leather 5 of the fur, as shown in FIG. 19, both the holder 8 and the hair 6 may be discharged. It has been realised that the required charge on the holder and on the hairs need not be very high to provide the desired effect.

Figure 20:
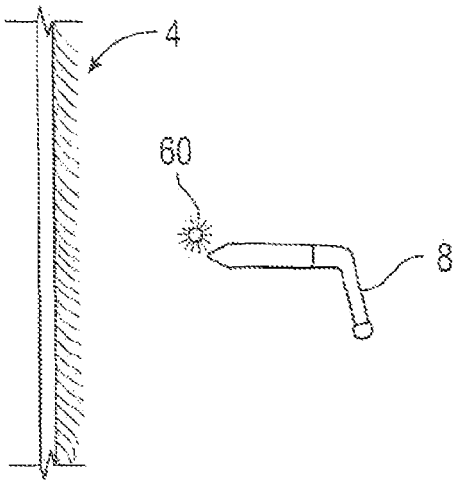
FIG. 20 shows a hair controller with brush.
Figure 21:
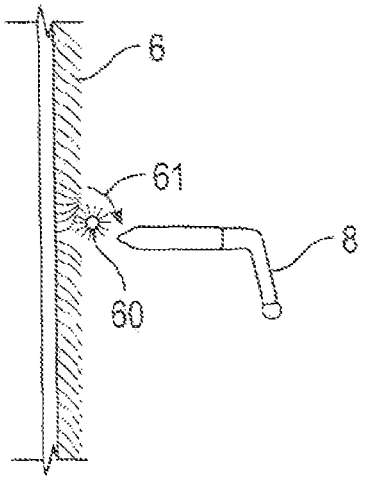
FIG. 21 shows the function of the hair controller with brush.
Figure 22:
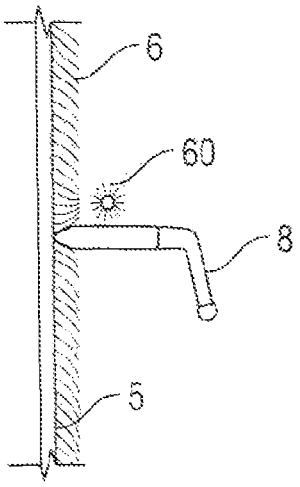
FIG. 22 shows the function of the hair controller with brush.

FIG. 20 shows yet another embodiment of the hair controller 60 according to the invention. The hair controller 60 is constituted by a brush that is adapted to rotate along the front of the holder 8 when the holder is activated, i.e. when the stretching machine is activated. The brush 60 of the hair controller rotates, as indicated by an arrow 61 in FIG. 21, and gently moves the hair 6 aside, allowing the holder 8 to engage an area of leather 5 on the fur 4. When the holder 8 engages the leather 5, as shown in FIG. 22, the brush is retracted from the fur 4. The means for rotating and retracting the brush are relatively simple mechanical devices, which are not shown in the figure.

Although the embodiment of the hair controller 60 is shown with only one brush, it may easily be envisaged that the embodiment may be realised with two brushes, which may have different rotations in respect of each other when the hair controller is activated.

Figure 23:
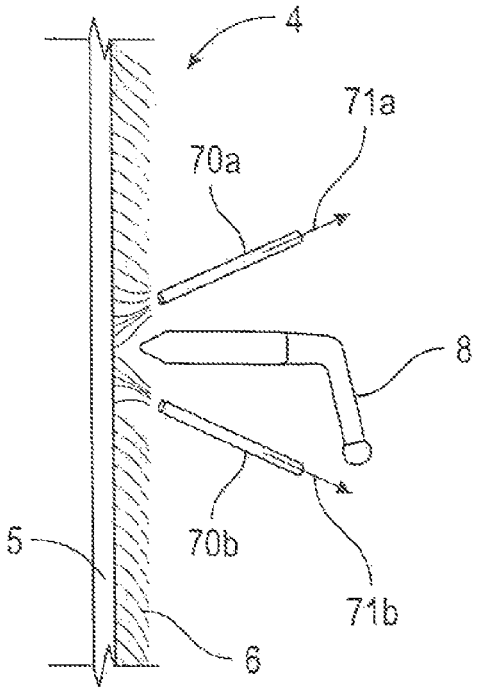
FIG. 23 shows the hair controller with suction means.

FIG. 23 shows an embodiment using suction or vacuum to move the hairs 6 aside to provide access for the holder 8 to the leather 5. The suction or vacuum is provided by hollow members 70*a*, 70*b*. The hollow members may have a tubular shape or be shaped to have a more elliptic or elongated cross-section, i.e. an orifice.

The suction effect is provided by a stream of air flowing through the hollow members 70*a* and 70*b* as indicated by arrows 71*a* and 71*b*. The flow of air through the hollow members is generated by a not shown suction means.

The suction by the hollow members 70*a* and 70*b* provides a vacuum near the surface of the pelt 4 which will move the hair aside. In the particular embodiment, hollow members are placed above and below the holder 8. However, in alternative embodiments it may only be necessary to provide suction means above or below the holder 8. The requirement of suction means depends on the nature of the hairs 6 on the pelt 4.

Figure 24:
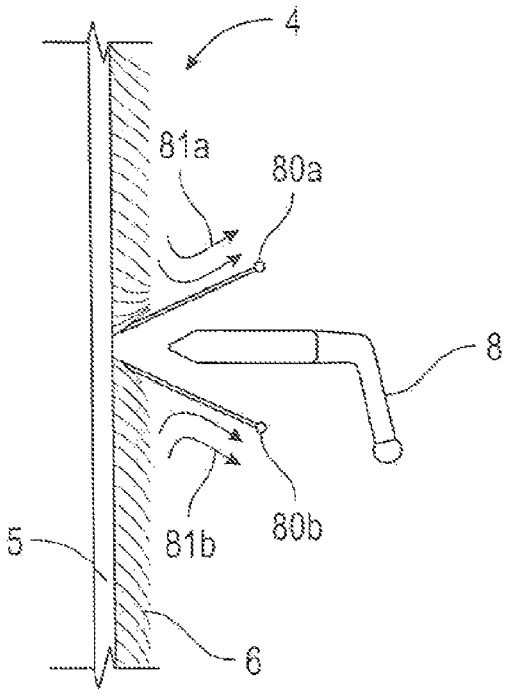
FIG. 24 shows an alternative embodiment of the hair controller with suction means.

FIG. 24 illustrates an alternative embodiment for providing a suction effect or vacuum for moving hairs aside. This embodiment makes use of plates 80*a* and 80*b* which are mounted at an angle above and below the holder 8. The angle between the plates 80*a* and 80*b* will be selected so that the plates form a tapering structure towards the pelt 4. The angle is conveniently between 10 and 90 degrees.

As illustrated, there is a flow of air 81*a* and 81*b* on the surfaces of the plates 80*a* and 80*b* facing away from the holder 8. The flow of air which is provided by not shown suction means will generate a suction effect or vacuum, which will facilitate the task of moving the hairs 6 aside to provide access to the leather 5 for the holder 8. The hairs 6 are moved aside by moving the plates 80*a* and 80*b* with a flow of air 81*a* and 81*b* towards the pelt 4.

Although the embodiment illustrated in FIG. 24 has similarities with the embodiment shown in the FIGS. 14 to 16, the plates 80*a* and 80*b* are not required to be tiltable due to the added suction effect.

The means for providing compressed air, a flow of air, or a suction effect may simple be connected with the devices for generating compressed air, which are normally present in a stretching machine.

The stretching machine comprising the hair controller according to the invention comprises several embodiments, and not all the embodiments are illustrated in the figures. For example, the hair controller may also be constituted by a vibrating holder utilising vibrations to move hair aside. A vibrating holder may also be combined with one or more of the embodiments described above. Consequently, a skilled person may be able to teach several other embodiments within the scope of the present invention.

The invention claimed is:

1. Apparatus for use with a stretching machine for stretching a pelt on a pelt board, wherein the pelt has a leather side in contact with the pelt board and a hair side covered with hair, the apparatus comprising:

a hair controlling device operatively associated with the pelt board and operable to move the hair on the hair side of the pelt so as to provide an exposed leather area on the hair side of the pelt; and a holder operable to engage the pelt at the exposed leather area so as to hold the pelt against the pelt board while the pelt is being stretched.

2. The apparatus of claim 1, wherein the hair controlling device is mounted on the holder.

3. The apparatus of claim 1, wherein the hair controlling device is integrated within the holder.

4. The apparatus of claim 1, wherein the hair controlling device includes an air nozzle connectable to a source of air and configured to deliver a stream of air from the source of air to the hair side of the pelt.

5. The apparatus of claim 4, wherein the air nozzle is configured to deliver the stream of air in a substantially laminar flow.

6. The apparatus of claim 1, wherein the hair controlling device is configured to move the hair by the application of a suction effect to the hair side.

7. The apparatus of claim 6, wherein the hair controlling device includes a suction tube configured to apply the suction effect to the hair side.

8. The apparatus of claim 6, wherein the hair controlling device includes a pair of plates movably mounted with respect to the hair side of the pelt so as to form a tapering structure configured to direct a flow of air away from the hair side of the pelt to apply the suction effect.

9. The apparatus of claim 1, wherein the hair controlling device comprises first and second movable plates configured and operable to move the hair on the hair side of the pelt so as to provide the exposed leather area.

10. The apparatus of claim 9, wherein at least one of the first and second movable plates is configured to be vibrated or oscillated.

11. The apparatus of claim 1, wherein the hair controlling device includes an electrically-charged body operable to move the hair electrostatically.

12. The apparatus of claim 1, wherein the hair controlling device includes a rotatable brush movable between a hair-contacting position in which it is operable to move the hairs on the hair side so as to provide the exposed leather area, and a retracted position in which it is withdrawn from contact with the hair.

13. A method of stretching a pelt having a leather side and a hair side covered with hair, the method comprising:

(a) mounting the pelt on a pelt board with the leather side contacting the pelt board;

(b) placing the pelt board in a pelt-stretching machine;

(c) moving the hair on the hair side of the pelt so as to leave an exposed leather area on the hair side;

(d) engaging a pelt holder with the pelt at the exposed leather area so as to fix the pelt to the pelt board; and (e) while the pelt is fixed to the pelt board, operating the pelt-stretching machine to stretch the pelt.

14. The method of claim 13, wherein the step of moving the hair comprises directing a stream of air at the hair side of the pelt.

15. The method of claim 13, wherein the step of moving the hair comprises applying a suction to the hair side of the pelt.

16. The method of claim 13, wherein the step of moving the hair comprises moving one or more plates into engagement with the hair side of the pelt.

17. The method of claim 13, wherein the step of moving the hair comprises moving an electrically charged body toward the hair side of the pelt.

18. The method of claim 13, wherein the step of moving the hair comprises moving a rotating brush into contact with the hair.

* * * * *